US012369690B2

(12) United States Patent
Bishop et al.

(10) Patent No.: US 12,369,690 B2
(45) Date of Patent: Jul. 29, 2025

(54) INTEGRATED MANUAL PUMP FOR ARTICLE OF FOOTWEAR

(71) Applicant: NIKE, Inc., Beaverton, OR (US)

(72) Inventors: Jennifer L. Bishop, Portland, OR (US); Timothy P. Hopkins, Tustin, CA (US); Nicholas R. Long, Portland, OR (US); Todd W. Miller, Portland, OR (US); Nadia M. Panian, Beaverton, OR (US); Aaron K. Seid, Portland, OR (US); Richard Kristian Hansen, Vancouver, WA (US)

(73) Assignee: NIKE, Inc., Beaverton, OR (US)

( * ) Notice: Subject to any disclaimer, the term of this patent is extended or adjusted under 35 U.S.C. 154(b) by 60 days.

(21) Appl. No.: 18/306,059

(22) Filed: Apr. 24, 2023

(65) Prior Publication Data

US 2023/0346074 A1 Nov. 2, 2023

Related U.S. Application Data

(60) Provisional application No. 63/336,098, filed on Apr. 28, 2022.

(51) Int. Cl.
*A43B 23/02* (2006.01)

(52) U.S. Cl.
CPC ..... *A43B 23/029* (2013.01)

(58) Field of Classification Search
CPC ..... A43B 23/029; A43B 13/203; A43B 3/26; A43C 11/00
USPC ..... 36/97, 153
See application file for complete search history.

(56) References Cited

U.S. PATENT DOCUMENTS

| | | | | |
|---|---|---|---|---|
| 3,685,176 | A * | 8/1972 | Rudy | A43B 5/0407 36/71 |
| 5,392,534 | A * | 2/1995 | Grim | A43B 7/147 36/154 |
| 5,784,807 | A * | 7/1998 | Pagel | A43B 17/03 36/43 |
| 6,195,914 | B1 * | 3/2001 | Otis | A43B 3/26 36/11.5 |
| 7,131,218 | B2 | 11/2006 | Schindler | |
| 7,278,445 | B2 * | 10/2007 | Marvin | A43B 13/203 137/854 |
| 10,602,801 | B2 * | 3/2020 | Silva | A43B 7/1475 |
| 2012/0167413 | A1 | 7/2012 | Marvin et al. | |

(Continued)

FOREIGN PATENT DOCUMENTS

| | | |
|---|---|---|
| WO | WO-2016100170 A1 | 6/2016 |
| WO | WO-2017023532 A1 | 2/2017 |

OTHER PUBLICATIONS

European Patent Office (ISA), International Search Report and Written Opinion for PCT App. No. PCT/US2023/019734, mailed Aug. 2, 2023.

(Continued)

*Primary Examiner* — Jameson D Collier
(74) *Attorney, Agent, or Firm* — Honigman LLP; Matthew H. Szalach; Jonathan P. O'Brien

(57) ABSTRACT

An article of footwear includes an upper having a chamber, a sole structure including a recess forming a cavity, and a pump device disposed within the cavity, in fluid communication with the chamber, and operable to move the upper from a relaxed state to a constricted state by selectively evacuating fluid from the chamber.

19 Claims, 10 Drawing Sheets

(56) References Cited

U.S. PATENT DOCUMENTS

| | | | | |
|---|---|---|---|---|
| 2016/0122493 | A1 | 5/2016 | Farris et al. | |
| 2016/0242502 | A1 | 8/2016 | Spanks | |
| 2017/0360155 | A1* | 12/2017 | Leary | A43B 23/081 |
| 2018/0110286 | A1 | 4/2018 | Vuong | |
| 2019/0216167 | A1 | 7/2019 | Hoffer et al. | |
| 2021/0114507 | A1 | 4/2021 | Alexander et al. | |
| 2021/0120915 | A1 | 4/2021 | Panian | |
| 2021/0235819 | A1 | 8/2021 | Andreasen et al. | |
| 2021/0244128 | A1* | 8/2021 | Costa | A43B 3/0036 |
| 2022/0104582 | A1 | 4/2022 | Christensen et al. | |
| 2023/0033238 | A1* | 2/2023 | Hopkins | A43B 23/029 |

OTHER PUBLICATIONS

European Patent Office as ISA, International Search Report and Written Opinion for PCT App. No. PCT/US2022/024763, mailed Jun. 20, 2022.

USPTO, Final Office Action for U.S. Appl. No. 17/719,861, mailed Apr. 11, 2024.

European Patent Office (ISA), International Search Report and Written Opinion for PCT App. No. PCT/US2022/082024, mailed Apr. 18, 2023.

* cited by examiner

INTEGRATED MANUAL PUMP FOR ARTICLE OF FOOTWEAR

CROSS REFERENCE TO RELATED APPLICATION

This U.S. Non-provisional Patent Application claims priority under 35 U.S.C. § 119(e) to U.S. Provisional Patent Application Ser. No. 63/336,098, filed Apr. 28, 2022, the disclosure of which is hereby incorporated by reference in its entirety.

FIELD

The present disclosure relates generally to an article of footwear, and more particularly to a sole structure for an article of footwear

BACKGROUND

This section provides background information related to the present disclosure and is not necessarily prior art.

Articles of apparel, such as garments and headwear, and articles of footwear, such as shoes and boots, typically include a receptacle for receiving a body part of a wearer. For example, an article of footwear may include an upper and a sole structure that operate to form a receptacle for receiving a foot of a wearer. Likewise, garments and headwear may include one or more pieces of material formed into a receptacle for receiving a torso or head of a wearer.

Articles of apparel or footwear are typically adjustable and/or include a relatively flexible material to allow the article of apparel or footwear to accommodate various sizes of wearers, or to provide different fits on a single wearer. While conventional articles of apparel and articles of footwear are adjustable, such articles typically require a wearer to secure the article by lacing or other means. For example, while laces adequately secure an article of footwear to a wearer by contracting or constricting a portion of an upper around the wearer's foot, the laces do not cause the upper to lock in a size or shape conforming to the user's foot. Accordingly, an optimum fit of the upper around the foot is difficult to achieve.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1A:
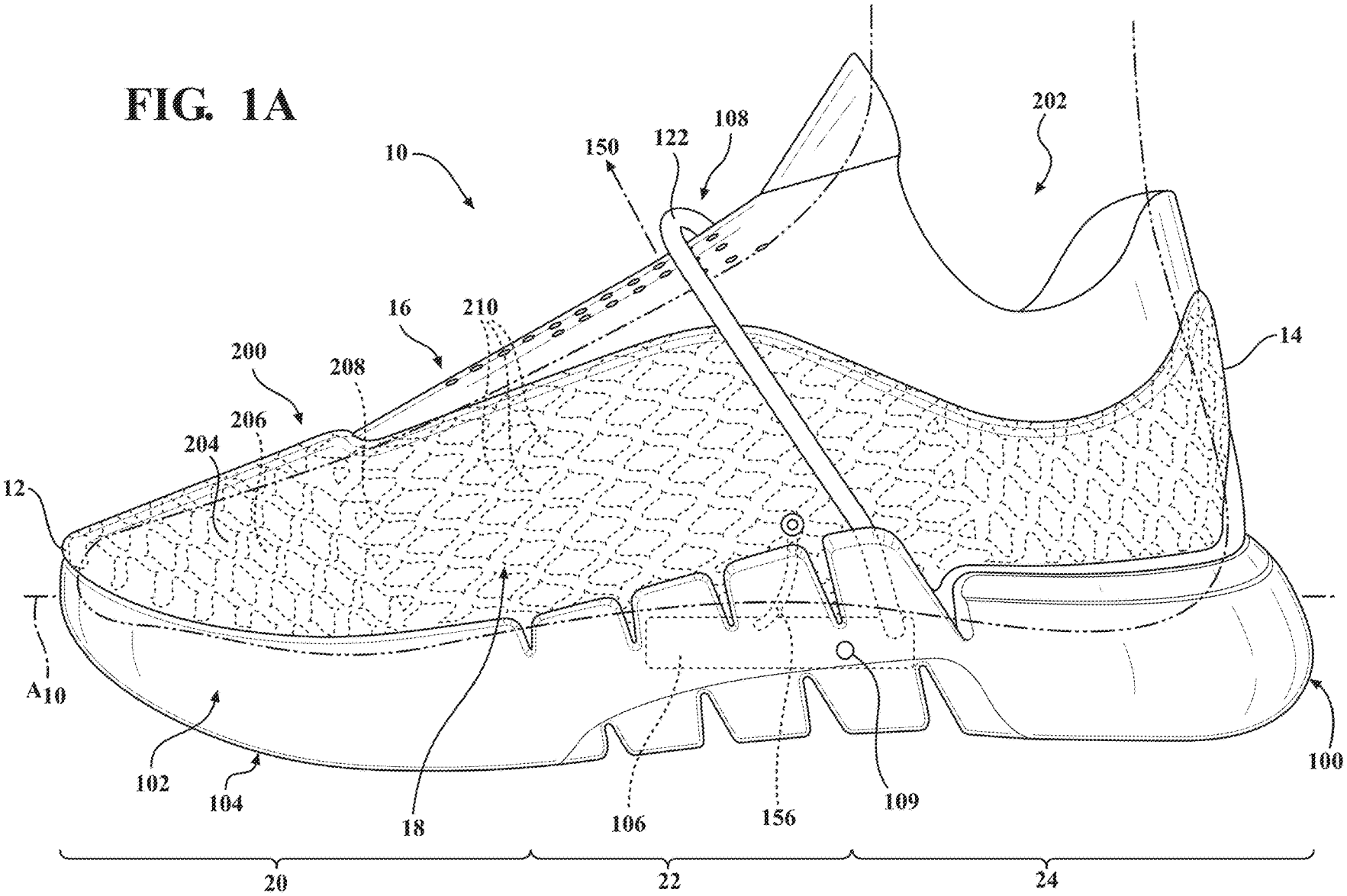
FIG. 1A is a lateral side perspective view of an article of footwear incorporating a manual pump according to an example of the present disclosure, where the article of footwear is in a relaxed state.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, an article of footwear is provided and includes an upper having a chamber, a sole structure including a recess forming a cavity, and a pump device disposed within the cavity, in fluid communication with the chamber, and operable to move the upper from a relaxed state to a constricted state by selectively evacuating fluid from the chamber.

The article of footwear may include one or more of the following optional features. For example, the article of footwear may include an actuator connected to the pump device and moveable in a tightening direction to move the upper from the relaxed state to the constricted state. The actuator may include an actuator cable including a first portion connected to the pump device and a second portion extending across the upper. The actuator cable may include a tightening grip extending across the upper and/or the pump device may include a piston coupled to the actuator.

In one configuration, the pump device may include at least one biasing member coupled to the piston. The at least one biasing member may bias the piston in a first direction and the actuator may be operable to move the piston in a second direction. A bearing may be coupled to the piston and the actuator may be connected to the bearing.

A release may be in fluid communication with the pump device and may be operable to move the upper from the constricted state to the relaxed state. Additionally or alternatively, the pump device may include a valve in fluid communication with the chamber of the upper.

In another configuration, an article of footwear is provided and includes an upper having a chamber, a pump attached to the article of footwear and in fluid communication with the chamber, the pump operable in a first state to evacuate fluid from the chamber, and an actuator having a first portion connected to the pump and a second portion disposed along the upper, the actuator operable to move the pump into the first state to move the upper from a relaxed state to a constricted state by evacuating a fluid from the chamber.

The article of footwear may include one or more of the following optional features. For example, the pump may include a housing and a piston disposed within the housing, the piston moveable in a first direction in the first state to draw fluid into the housing and in a second direction to exhaust fluid from the housing. In this configuration, the pump may include a biasing member operable to bias the piston in the second direction, the actuator may be operable to move the piston in the first direction, and/or a first portion of the actuator may be connected to the piston.

In one configuration, the housing may include a first bearing attached to the housing and the piston may include a second bearing attached to the piston, a first portion of the actuator may be routed along the first bearing and a second portion of the actuator may be routed along the second bearing. In this configuration, the first bearing may include an arcuate first bearing surface and the second bearing may include an arcuate second bearing surface facing an opposite direction than the arcuate first bearing surface.

The actuator may include a tightening grip extending around the upper. Additionally or alternatively, a release may be operable to selectively permit a flow of fluid into the chamber to move the upper from the constricted state to the relaxed state and/or the chamber may include a compressible component disposed within the chamber.

The details of one or more implementations of the disclosure are set forth in the accompanying drawings and the description below. Other aspects, features, and advantages will be apparent from the description, the drawings, and the claims.

Figure 1B:
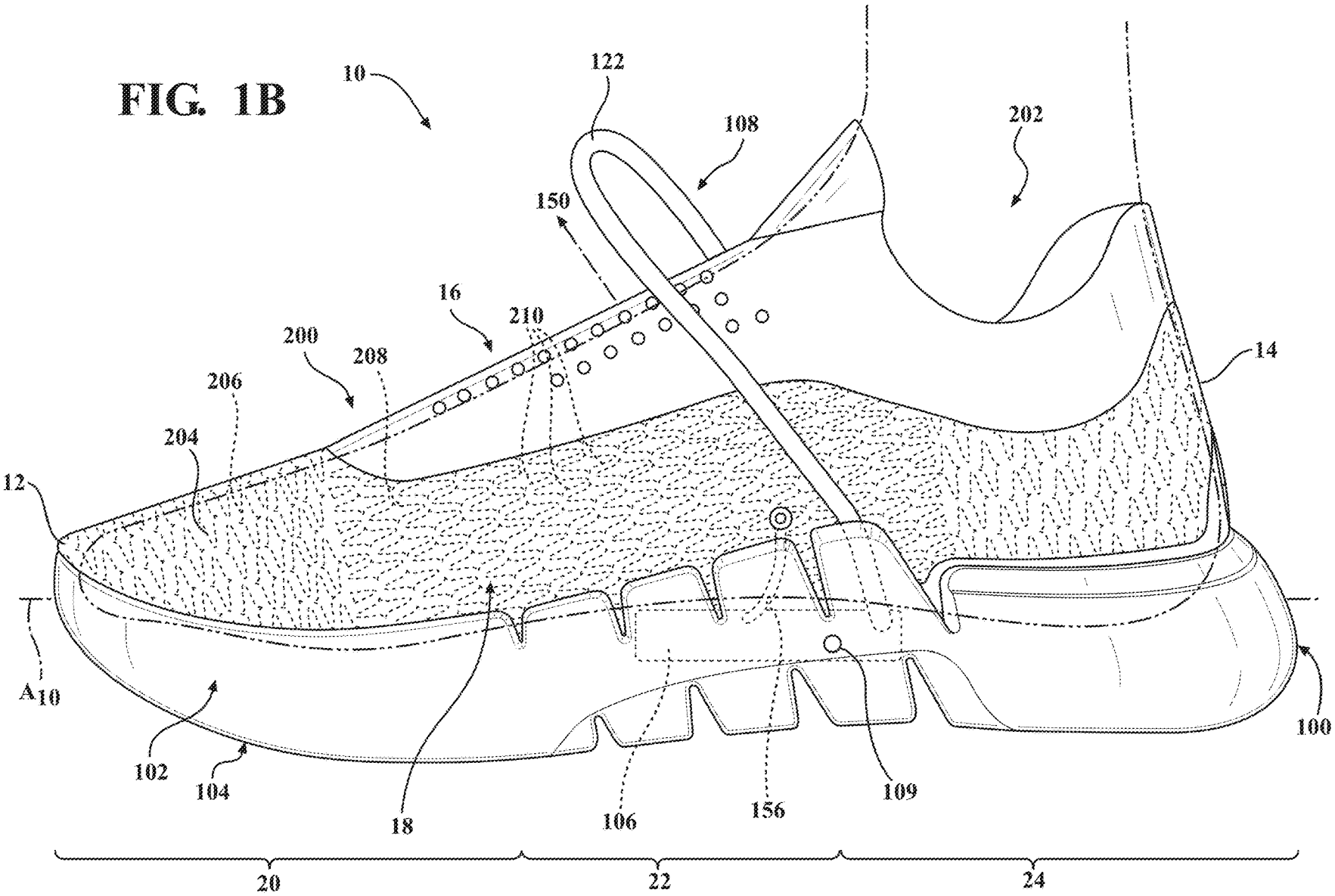
FIG. 1B is a lateral side perspective view of the article of footwear of FIG. 1A, where the article of footwear is in a constricted state.
Figure 2:
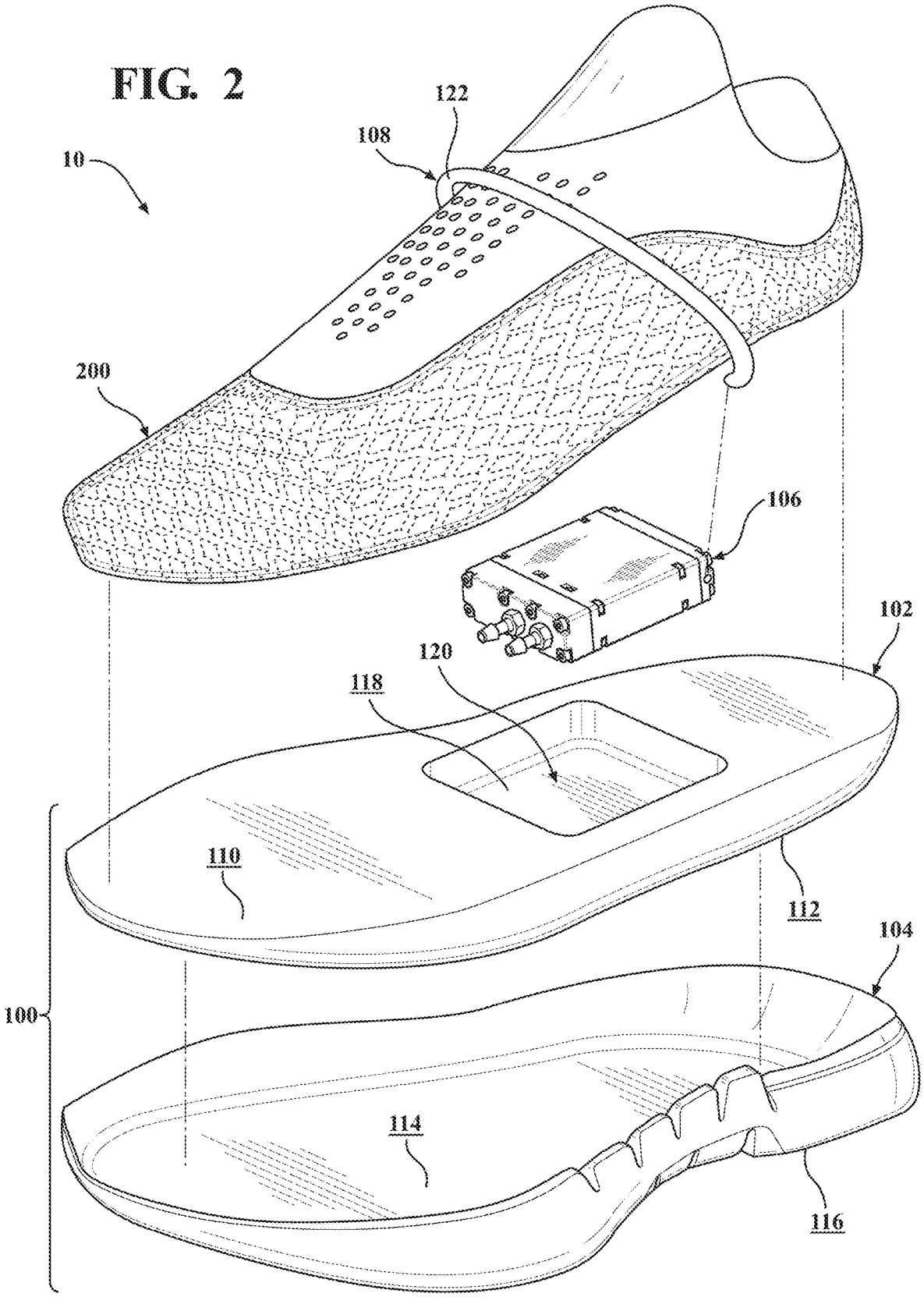
FIG. 2 is a top-front exploded perspective view of the article of footwear of FIG. 1A.

Referring to FIGS. 1A-2, an article of footwear 10 includes a sole structure 100 and an upper 200 attached to the sole structure 100. The article of footwear 10 may further include an anterior end 12 associated with a forward-most point of the footwear, and a posterior end 14 corresponding to a rearward-most point of the footwear 10. A longitudinal axis $A_{10}$ of the footwear 10 extends along a length of the footwear 10 from the anterior end 12 to the posterior end 14 parallel to a ground surface, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18.

The article of footwear 10 may be divided into one or more regions. The regions may include a forefoot region 20, a mid-foot region 22, and a heel region 24. The forefoot region 20 may correspond with the phalanges and the metatarsal bones of a foot. The mid-foot region 22 may correspond with an arch area of the foot, and the heel region 24 may correspond with rear portions of the foot, including a calcaneus bone.

As shown, the sole structure 100 includes a midsole 102 configured to provide cushioning and support and an outsole 104 defining a ground-engaging surface of the sole structure 100. In other examples, the midsole 102 may be configured as a composite structure including a plurality of components joined together.

The article of footwear 10 may be further described as including a pump device 106, an actuator cable 108, and a release feature 109. The pump device 106 is disposed in the sole structure 100 and may be in fluid communication with the upper 200 through one or more valves to adjust the pressure in the upper 200 from a first pressure (e.g., at or above ambient) to a second pressure (e.g., below ambient) by removing fluid (e.g., a gas or liquid) from the upper 200. In the illustrated example, the actuator cable 108 is embodied as an actuator cable 108 including a continuous loop that is routed through the pump device 106 and includes a tightening grip 122 extending across the upper 200. The release feature 109 may be connected to an outside surface of the sole structure 100 and is in fluid communication with the pump device 106 through one or more valves. As discussed in greater detail below, the pump device 106, the actuator cable 108, and the release feature 109 cooperate to transition the upper 200 between a relaxed state (FIG. 1A) and a constricted state (FIG. 1B).

With continued reference to FIG. 2, the midsole 102 is further defined by a top surface 110 facing the upper 200, and a bottom surface 112 formed on an opposite side of the midsole 102 than the top surface 110 and facing away from the upper 200. Stitching or adhesives may secure the midsole 102 to the upper 200. The top surface 110 of the midsole 102 includes a foot cavity that defines a footbed of the sole structure 100 extending continuously from the anterior end 12 to the posterior end 14 of the footwear 10. The outsole 104 is defined by a top surface 114 facing the bottom surface 112 of the midsole 102, and a bottom surface 116 that defines a ground-engaging surface and is formed on an opposite side of the outsole 104 than the top surface 114.

As shown, a recessed surface 118 is offset from the top surface 110 of the midsole 102 to form a cavity 120 in the top surface 110 midsole 102. The cavity 120 may be sized to receive the pump device 106. While FIG. 2 shows the cavity 120 disposed in the mid-foot region 22 of the midsole 102, the cavity 120 may alternatively be disposed in the forefoot region 20 or the heel region 24 of the midsole 102. In some implementations, the midsole 102 and the outsole 104 are integrally formed and receive the pump device 106. Alternatively, the pump device 106 may be located on an outer surface of the article of footwear (not shown) to allow access to the pump device 106.

Figure 3:
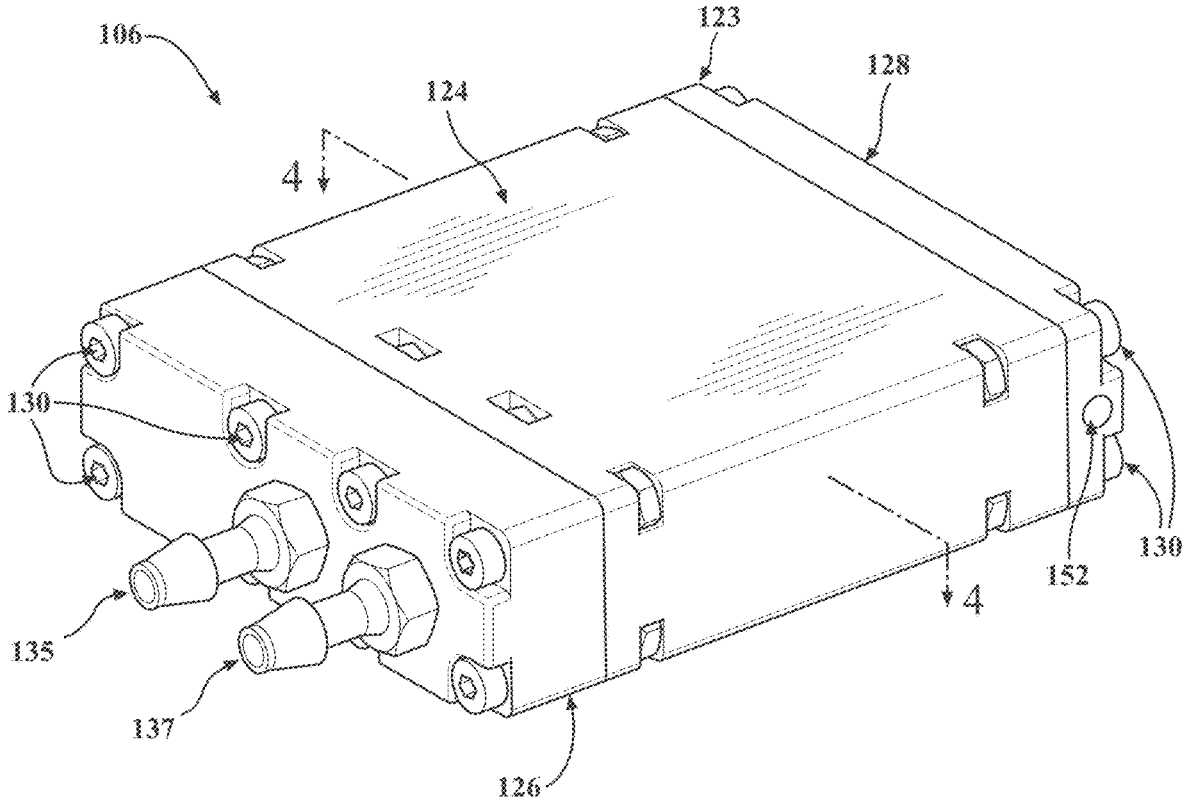
FIG. 3 is a perspective view of the manual pump according to an example of the present disclosure.
Figure 4A:
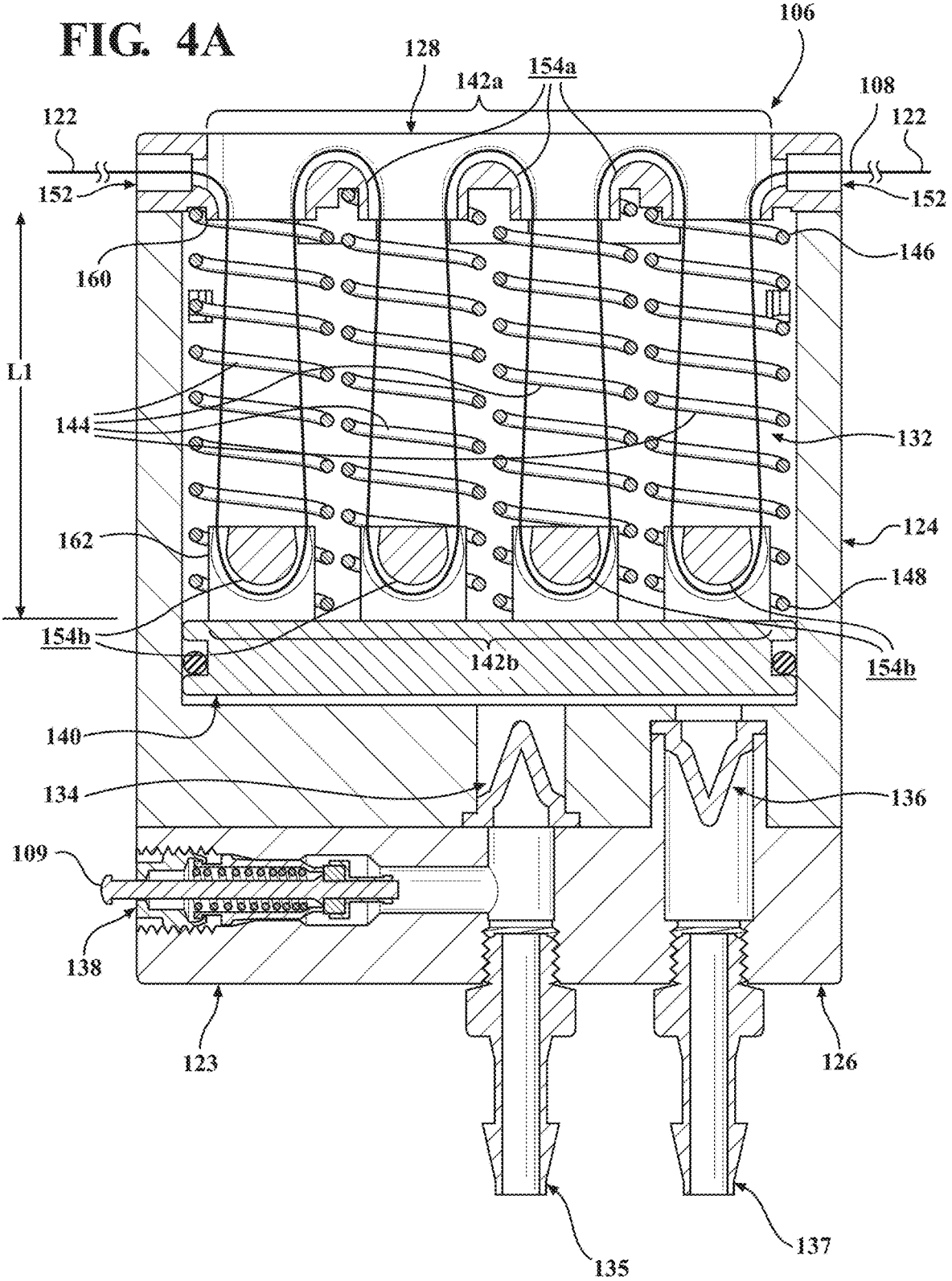
FIG. 4A, is cross-sectional view of the manual pump of FIG. 3, taken along line 4-4 in FIG. 3, where the manual pump is in a first configuration.
Figure 4B:
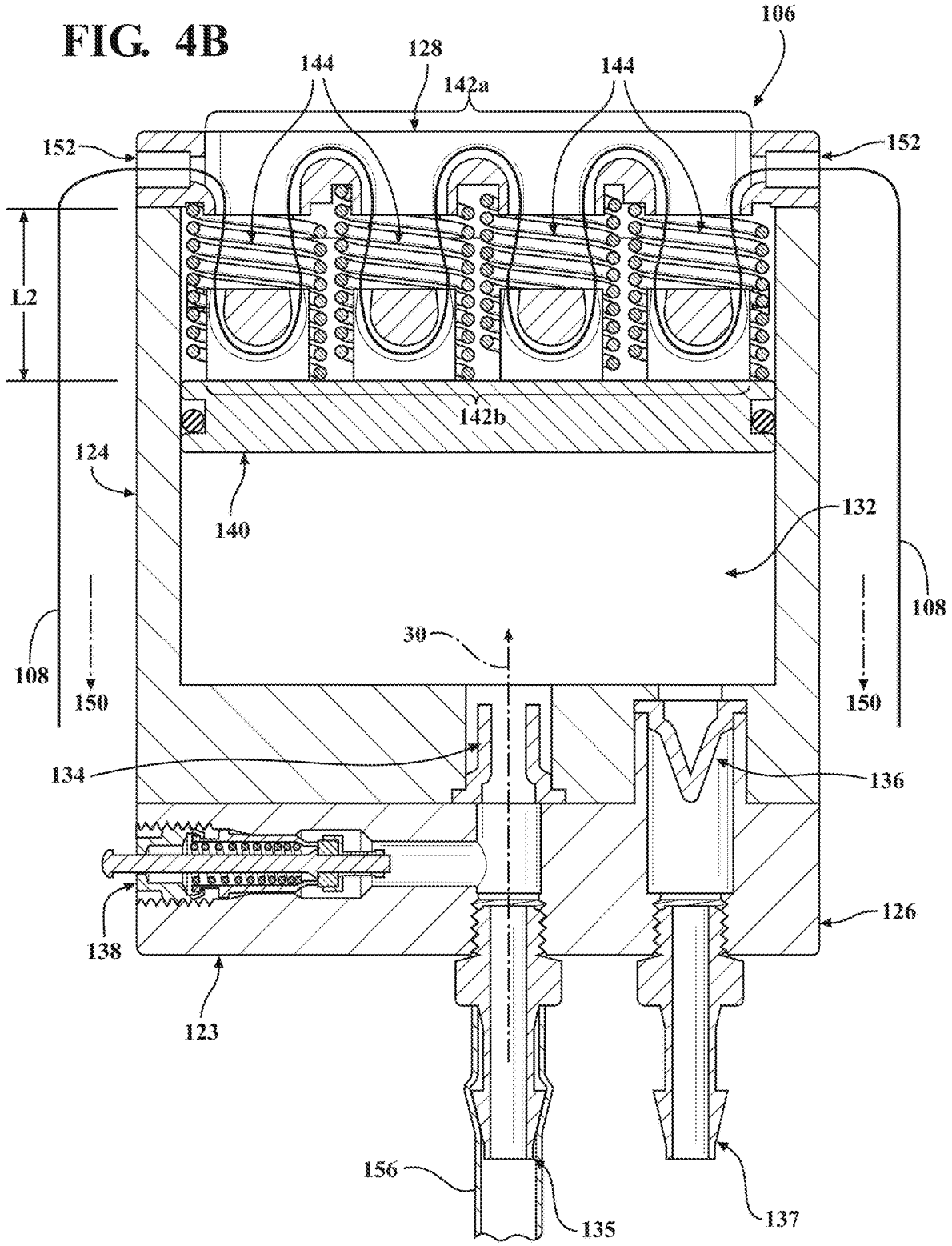
FIG. 4B is a cross-sectional view of the manual pump of FIG. 3, taken along line 4-4 in FIG. 3, where the manual pump is in a second configuration.
Figure 4C:
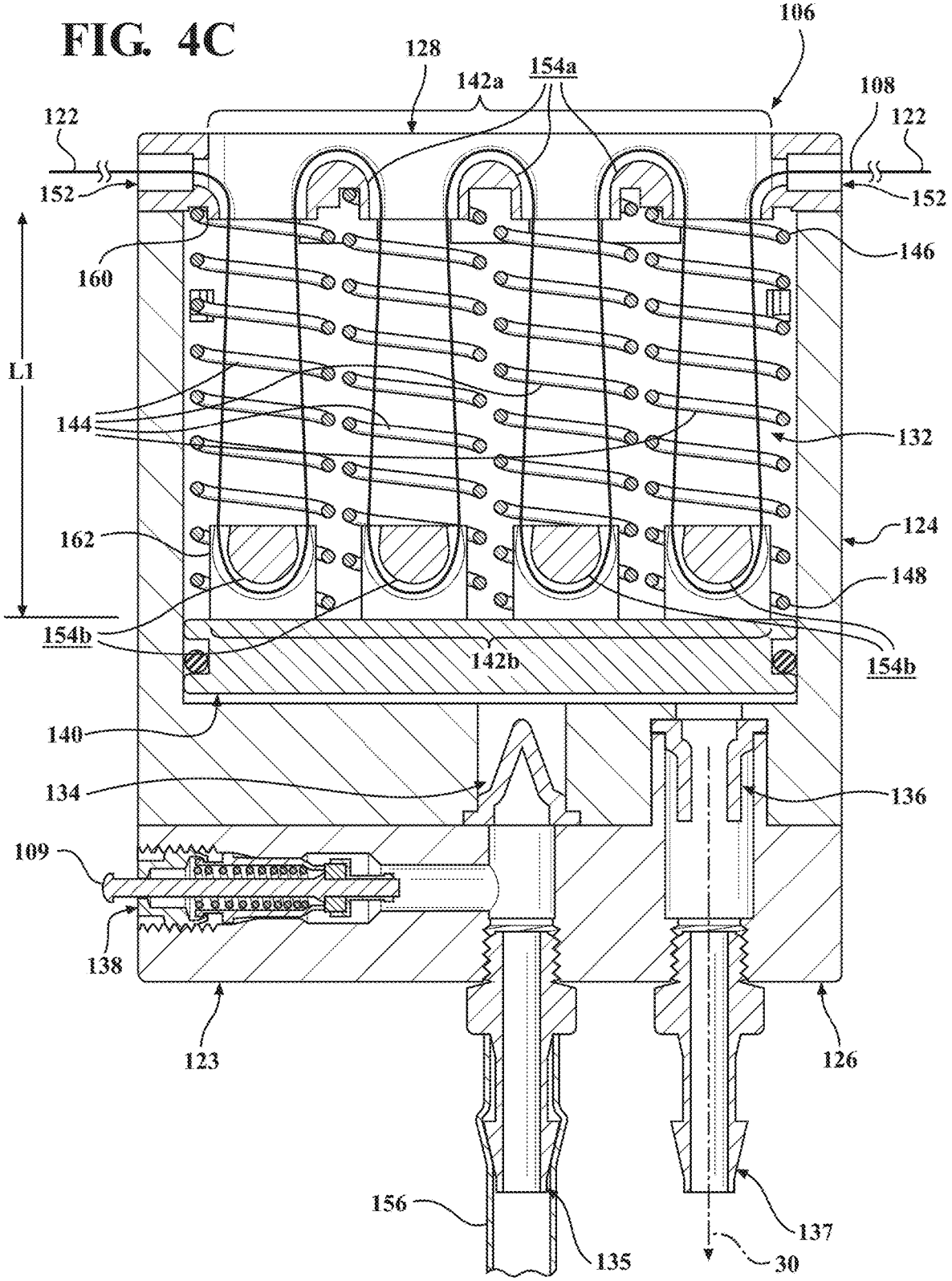
FIG. 4C, is cross-sectional view of the manual pump of FIG. 3, taken along line 4-4 in FIG. 3, where the manual pump is in a first configuration.
Figure 4D:
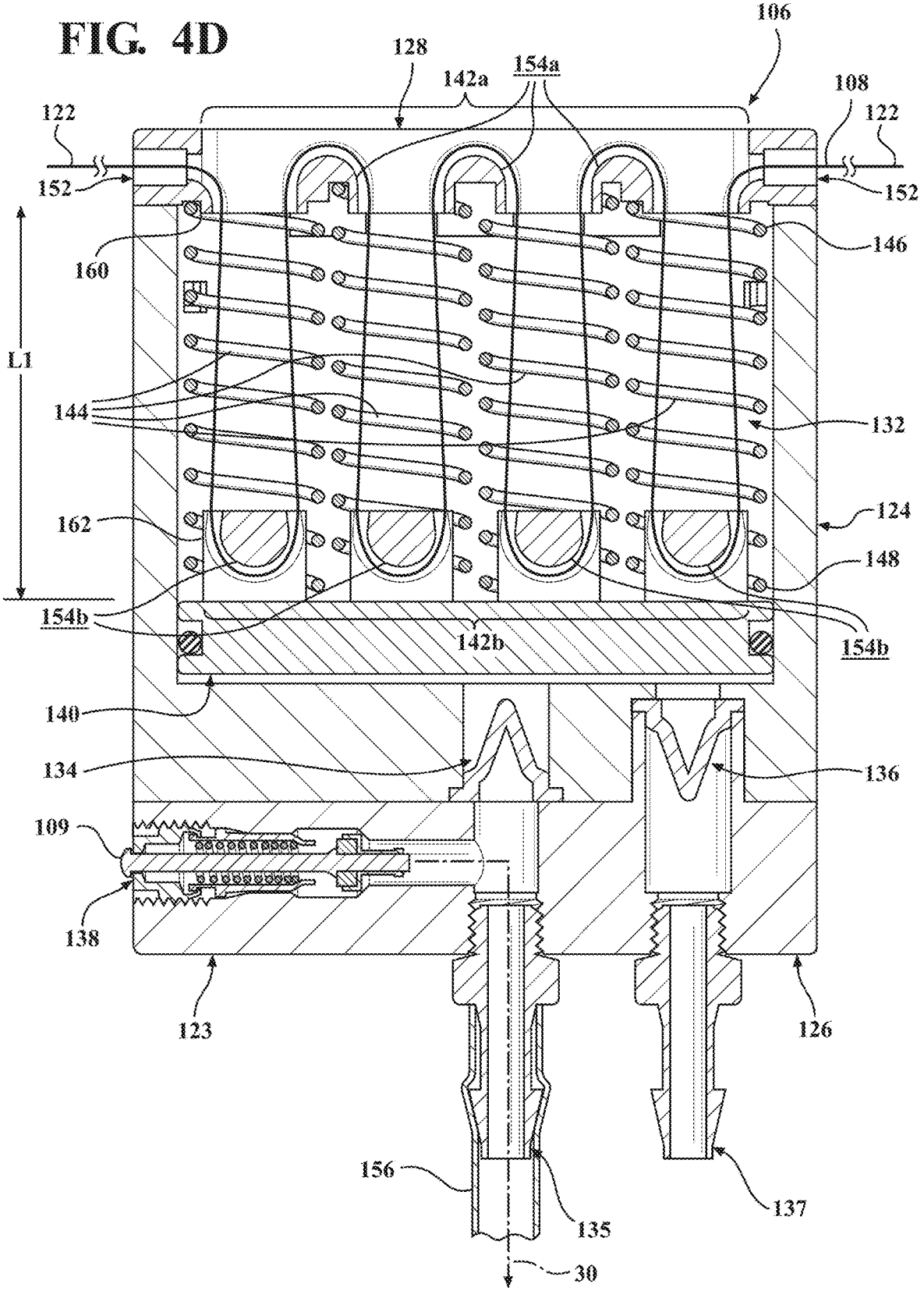
FIG. 4D, is cross-sectional view of the manual pump of FIG. 3, taken along line 4-4 in FIG. 3, where the manual pump is in a first configuration.

Referring to FIGS. 3-4D, the pump device 106 includes a housing 123 having an outer shell 124, a check valve endcap 126, and a piston endcap 128. Securing means 130 releasably fasten the outer shell 124, the check valve endcap 126, and the piston endcap 128 together to enclose a chamber 132 defined by the housing 123. The outer shell 124, the check valve endcap 126, and the piston endcap 128 may be include any suitable lightweight material, such as polyamide, polypropylene, carbon, or an aluminum alloy. Accordingly, the chamber 132 desirably has a low gas transmission rate to preserve its retained gas pressure. While the securing means 130 shown in FIG. 3 includes socket head bolts, any method for securing the check valve endcap 126 and the piston endcap 128 to the outer shell 124 may be used. Optionally, the housing 123 may be formed as a unitary structure, whereby the outer shell 124 is integrally formed with one or both of the check valve endcap 126 and the piston endcap 128.

The check valve endcap 126 includes an inlet check valve 134 configured to selectively allow fluid to flow into the chamber 132, an exhaust check valve 136 configured to selectively permit fluid to flow out of the chamber 132, and a release valve 138 fluidly coupled to an upstream end of the inlet check valve 134. As shown, the check valve endcap 126 further includes an intake port 135 connecting the inlet check valve 134 and the release valve 138 of the pump device 106 to the upper 200, and an exhaust port 137 connecting the exhaust check valve 136 of the pump device 106 to the upper 200. The inlet check valve 134 and the exhaust check valve 136 are further in fluid communication with the chamber 132 of the pump device 106. In some implementations, the release valve 138 is a Schrader valve that is selectively activated by the release feature 109 to allow outside air (e.g., ambient) to enter the upper 200 via the intake port 135 to return the upper 200 to a relaxed state from a constricted state.

As shown, the piston endcap 128 is disposed on an opposite end of the housing 123 than the check valve endcap 126. Accordingly, the check valve endcap 126 encloses a first end of the chamber 132 and the piston endcap 128 encloses an opposite second end of the chamber 132. The piston endcap 128 may include a plurality of cap bearings 142*a* spaced apart from each other to define a series of apertures 152. As shown, each of the cap bearings 142*a* defines a series of arcuate first bearing surfaces 154*a* formed on the piston endcap 128. The apertures 152 may be configured to receive and route the actuator cable 108 that extends into the chamber 132 of the pump device 106, while the first bearing surfaces 154*a* further route the actuator cable 108 within the chamber 132. Specifically, the first bearing surfaces 154*a* have a convex curvature (e.g., semi-cylindrical) facing in an opposite direction from the chamber 132. Thus, as shown in FIGS. 4A and 4B, first portions of the actuator cable 108 may be routed around the first bearing surfaces 154*a* and into the chamber 132 through the spaces disposed on either side of each cap bearing 142*a*.

As shown, the pump device 106 further includes a piston 140 including a plurality of piston bearings 142*b* configured to cooperate with the first bearing surfaces 154*a* of the piston endcap 128 to route the actuator cable 108 through the pump device 106. As discussed in greater detail below, the piston 140 is configured to reciprocate within the chamber 132 between a first position adjacent to the check valve endcap 126 (FIG. 4A) and a second position spaced apart from the check valve endcap 126 (FIG. 4B) when the actuator force is applied to the actuator cable 108 (e.g., pulling the tightening grip 122) in the tightening direction 150.

The piston bearings 142*b* each include an arcuate second bearing surface 154*b* facing away from the plurality of first bearing surfaces 154*a* for routing the actuator cable 108 within the pump device 106. In some implementations, the piston bearings 142*b* are integrally formed with the piston 140. In other implementations, the piston bearings 142*b* are mechanically attached to the piston 140 (e.g., welded, bonded, etc.). As shown, each of the piston bearings 142*b* is offset with respect to the cap bearings 142*a*. In other words, the piston bearings 142*b* are aligned with the apertures 152 disposed between adjacent ones of the cap bearings 142*a* across the length of the chamber 132. Each of the second bearing surfaces 154*b* has a convex curvature similar to the first bearing surfaces 154*a*. Thus, as shown in FIGS. 4A and 4B, a second portion of the actuator cable 108 may be routed into the chamber 132 through the apertures 152 and extend around the second bearing surfaces 154*b*.

With continued reference to FIGS. 4A and 4B, the pump device 106 includes one or more biasing members 144 configured to bias the piston 140 towards the second position (FIG. 4B). In the illustrated example, the biasing members 144 include coil springs 144 each extending from a first end 146 coupled to the piston endcap 128 to a second end coupled to the piston 140. Here, the piston endcap 128 may include one or more first spring seats 160 each engaging the first end 146 of one of the springs 144 to secure the first end 146 to the piston endcap 128. Similarly, the piston 140 may include one or more second spring seats 162 each engaging the second end 148 of one of the springs 144 to secure the second end 148 to the piston endcap 128. As shown in FIG. 4A, each of the first spring seats 160 may be integrally formed with one of the cap bearings 142*a* and each of the second spring seats 162 may be integrally formed with one of the piston bearings 142*b*.

While the illustrated example of the pump device 106 includes four springs 144, in some implementations the plurality of springs 144 may include any number of springs 144 (e.g., two springs). The material of the springs 144 may be selected based on a compression value associated with the springs 144. The springs 144 are configured to compress when a force is applied to the piston bearings 142*b* (i.e., the actuator cable 108 is pulled in a tightening direction 150), and exert an opposing force to return to a resting length when the force is released (i.e., the actuator cable 108 is released). In some examples, the springs 144 are formed from steel (e.g., stainless steel, a steel alloy, etc.). In other examples, the springs 144 are formed from carbon or other lightweight non-metals.

When the pump device 106 is assembled, the actuator cable 108 is routed through the apertures 152 on either side of the pump device 106, and through the plurality of springs 144 via the bearing surfaces 154*a*, 154*b*. Thus, as the actuator cable 108 is pulled in the tightening direction 150 (i.e., a tensile force is applied), the actuator cable 108 engages with the bearing surfaces 154*a*, 154*b* to draw the piston 140 toward the piston endcap 128, thereby compressing the springs 144. When the actuator cable 108 is released, the springs 144 exert an opposing force on the piston 140 to separate the piston 140 from the piston endcap 128, thereby returning the piston 140 to its original position and drawing a length of the actuator cable 108 back into the chamber 132. Accordingly, the actuator cable 108 is operable to actuate the piston 140 between the first position associated with a first length L1 where the springs 144 are in a resting state (FIG. 4A), and a second position associated with a second length L2 where the springs 144 are in a compressed state (FIG. 4B).

The actuator cable 108 may be highly lubricous and/or may be formed from one or more fibers having a low modulus of elasticity and a high tensile strength. For instance, the fibers may include high modulus polyethylene fibers having a high strength-to-weight ratio and a low elasticity. Additionally or alternatively, the actuator cable 108 may be formed from a molded monofilament polymer and/or a woven steel with or without other lubrication coating. In some examples, the actuator cable 108 includes multiple strands of material woven together.

Referring still to FIGS. 4A-4D, the routing of the actuator cable 108 within the chamber 132 of the pump device 106 is shown. The actuator cable 108 can be described as extending into the chamber 132 via the apertures 152. The actuator cable 108 is further routed within the springs 144 and alternatingly between the first bearing surfaces 154*a* of the piston endcap 128 and the second bearing surfaces 154*b* of the piston 140. As best shown in FIG. 4A, while the piston 140 is in the first position associated with the first length L1 of the springs 144, the actuator cable 108 extends fully throughout the chamber 132. In FIG. 4B, a tightening force has been applied in the tightening direction 150, thereby pulling the actuator cable 108 out of the chamber 132 through the apertures to pull the piston 140 into the second position associated with the second length L2 of the springs. As discussed below, the piston 140 is cycled between the first position and the second position to draw fluid in through the intake port 135 and to exhaust fluid out through the exhaust port 137.

Referring briefly to FIGS. 1A and 1B, the upper 200 may be formed from one or more materials that are stitched or adhesively bonded together to define the interior void 202. Suitable materials of the upper 200 may include, but are not limited to, textiles, foam, leather, and synthetic leather. The example upper 200 may be formed from a combination of one or more substantially inelastic or non-stretchable materials and one or more substantially elastic or stretchable materials disposed in different regions of the upper 200 to facilitate movement of the article of footwear 10 between the constricted state and the relaxed state. The one or more elastic materials may include any combination of one or more elastic fabrics such as, without limitation, spandex, elastane, rubber or neoprene. The one or more inelastic materials may include any combination of one or more of thermoplastic polyurethanes, nylon, leather, vinyl, or another material/fabric that does not impart properties of elasticity.

In the illustrated example, the upper 200 includes one or more fluid chambers 204 in fluid communication with the pump device 106. Each of the chambers 204 includes a compressible component 206 disposed therein which compresses as the upper 200 transitions from the relaxed state (FIG. 1A) to the constricted state (FIG. 1B). The compressible component 206 may include a lattice structure 208 defining a plurality of reliefs 210 (e.g., openings). As discussed above with reference to FIGS. 1A and 1B, the pump device 106 is in fluid communication with the chambers 204 of the upper 200. In these implementations, an intake conduit 156 connects the intake port 135 including the inlet check valve 134 to the chambers 204 of the upper 200 allowing fluid communication between the pump device 106 and the upper 200.

In use, the pressure within the chambers 204 of the upper 200 is reduced by drawing a vacuum within the chambers 204 of the upper 200 via the pump device 106. As the pressure is reduced, the upper 200 moves from a relaxed state to a constricted state that forms the upper 200 around the wearer's foot. Thus, as the vacuum is drawn by cycling the pump device 106, as described below with respect to FIGS. 4A-4C, fluid is drawn from within the chambers 204 of the upper 200 and into the chamber 132 of the pump device 106 to compress the lattice structure 208 of the compressible component 206, thereby constricting the upper 200 around the foot of the wearer. When the release valve 138 is actuated, the lattice structure 208 of the compressible component 206 expands within each chamber 204, thereby causing an internal volume of the chamber 204 to increase. The increase in volume draws fluid from the release valve 138 through the intake port 135 and allows the upper 200 to move to the relaxed state around the wearer of the foot. Optionally, the upper 200 may include a locking system which, when activated, locks the geometry of the upper 200 in place once it is in the constricted state.

With continued reference to FIGS. 4A-4D, the upper 200 may be transitioned between the relaxed state and the constricted state via the pump device 106. Here, a vacuum may be drawn by pulling the actuator cable 108 in the tightening direction 150 and releasing the actuator cable 108 for a number of cycles. As the actuator cable 108 is pulled in the tightening direction 150, the piston 140 is moved from the first position (FIG. 4A) to the second position (FIG. 4B), creating a vacuum and drawing fluid 30 from the upper 200 into the chamber 132 via the intake port 135 and the inlet check valve 134. Once the piston 140 is at the second position, the inlet check valve 134 closes to prevent the fluid 30 from escaping from the chamber 132 back into the chambers 204 of the upper.

When the actuator cable 108 is released, the springs 144 bias the piston 140 from the second position (FIG. 4B) to the first position (FIG. 4C), drawing the actuator cable 108 back into the pump device 106 and exhausting the fluid 30 within the chamber 132 through the exhaust check valve 136 and the exhaust port 137. Thus, the fluid 30 drawn from the chambers 204 when the piston 140 moves from the first position to the second position is exhausted from the pump device 106 when the piston returns from the second position to the first position. Accordingly, the steps of pulling the actuator cable 108 in the tightening direction 150 followed by releasing the actuator cable 108 constitutes a cycle. For each cycle that the actuator cable 108 is pulled in the tightening direction 150 and then released, the pressure within the upper 200 is incrementally reduced. In some examples, the pressure within the upper 200 reaches an ideal pressure to constrict the upper 200 (e.g. −5 psi) after 20 pulls on the actuator cable 108 in the tightening direction 150. In other examples, fewer pulls on the actuator cable 108 are required.

Referring to FIG. 4D, when the wearer wishes to move the upper 200 to the relaxed state, the wearer increases the pressure within the chambers 204 of the upper 200 by pressing the release feature 109 of the release valve 138. Specifically, the wearer may press the release feature 109 located on the outer surface of the sole structure 100, which biases the release valve 138 to an open position to allow ambient air to flow into the chambers 204 of the upper 200 via the intake port 135. Consequently, the pressure within the chambers 204 of the upper 200 increased, and the upper 200 transitions from the constricted state (FIG. 1B) to the relaxed state (FIG. 1A) around the wearer's foot.

Figure 5A:
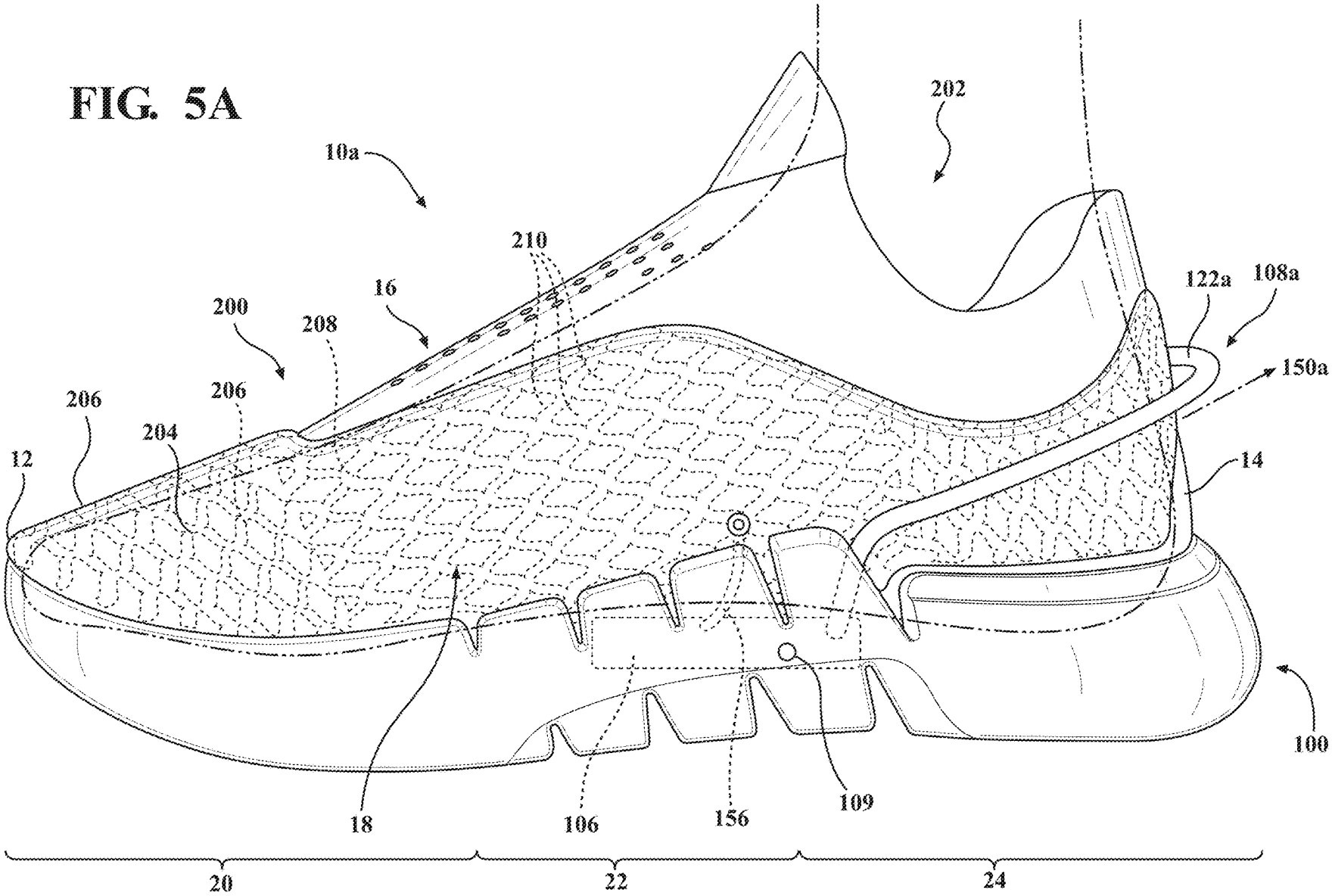
FIG. 5A is a lateral side perspective view of an article of footwear incorporating a manual pump according to the present disclosure, where the article of footwear is in a relaxed state.
Figure 5B:
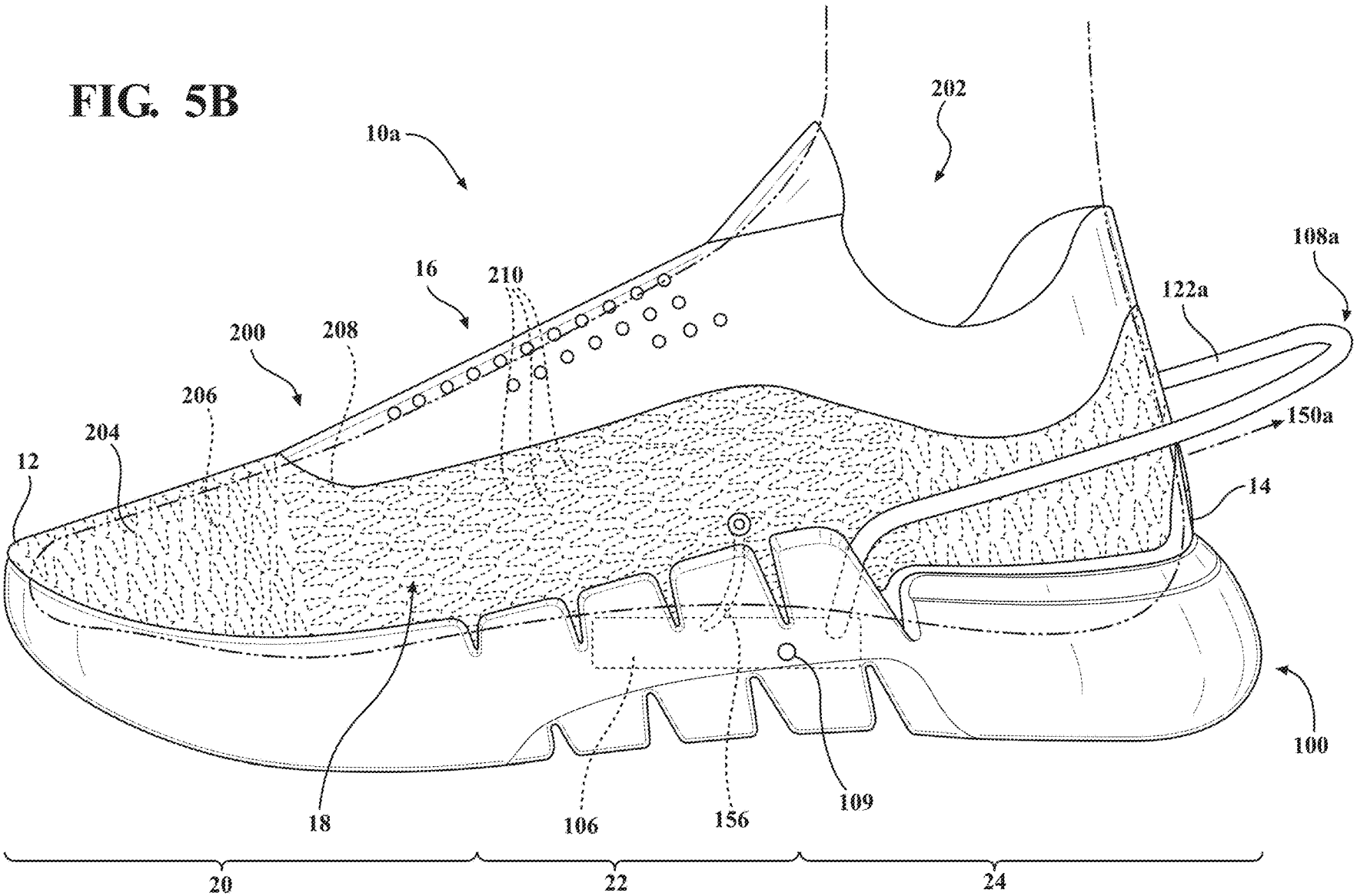
FIG. 5B is a lateral side perspective view of the article of footwear of FIG. 5A, where the article of footwear is in a constricted state.

With particular reference to FIGS. 5A and 5B, another example of a configuration of an article of footwear 10*a* having a pump device 106 is shown. In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

The article of footwear 10*a* includes the sole structure 100 having a pump device 106 discussed above with respect to FIGS. 1-4D, but includes an upper 200 having an alternative routing of an actuator cable 108*a* including a tightening grip 122*a* routed around the posterior end 14 of the heel region 24 of the upper 200. Here, a vacuum may be drawn by pulling the actuator cable 108*a* in a tightening direction 150*a* and releasing the actuator cable 108*a* for a number of cycles. As the actuator cable 108*a* is pulled in the tightening direction 150*a*, the piston 140 of the pump device 106 is moved from the first position to the second position, drawing a vacuum from the upper 200 into the chamber 132 thereby increasing the pressure within the chamber 132 of the pump device 106 from a first pressure to a second pressure higher than the first pressure. When the actuator cable 108*a* is released, the springs 144 return the piston 140 to the first position, drawing the actuator cable 108*a* back into the pump device 106 and exhausting the second pressure within the chamber 132 through the exhaust check valve 136. Accordingly, the steps of pulling the actuator cable 108*a* in the tightening direction 150*a* followed by releasing the actuator cable 108*a* constitutes a cycle. For each cycle that the actuator cable 108*a* is pulled in the tightening direction 150*a* and then released, the pressure within the upper 200 is incrementally reduced. In some examples, the pressure within the upper 200 reaches an ideal pressure to constrict the upper 200 (e.g. −5 psi) after 20 pulls on the actuator cable 108 in the tightening direction 150. In other examples, fewer pulls on the actuator cable 108 are required.

The midsole 102 and the outsole 104 include a resilient polymeric material, such as foam or rubber, to impart properties of cushioning, responsiveness, and energy distribution to the foot of the wearer. In the illustrated example, the midsole 102 is formed of a first foam material, and the outsole 104 is formed of a second foam material. For example, the midsole 102 may include foam materials providing greater cushioning and impact distribution, while the outsole 104 includes a foam material having a greater stiffness and/or rigidity in order to provide increased lateral stiffness to the sole structure 100.

Example resilient polymeric materials for the midsole 102 and the outsole 104 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a cross-linking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

The following Clauses provide an exemplary configuration for a pump for use with a sole structure for an article of footwear, a sole structure for an article of footwear, and an article of footwear described above.

Clause 1. An article of footwear comprising an upper including a chamber, a sole structure including a recess forming a cavity and a pump device disposed within the cavity, in fluid communication with the chamber, and operable to move the upper from a relaxed state to a constricted state by selectively evacuating fluid from the chamber.

Clause 2. The article of footwear of Clause 1, further comprising an actuator connected to the pump device and moveable in a tightening direction to move the upper from the relaxed state to the constricted state.

Clause 3. The article of footwear of Clause 2, wherein the actuator includes an actuator cable including a first portion connected to the pump device and a second portion extending across the upper.

Clause 4. The article of footwear of Clause 3, wherein the actuator cable includes a tightening grip extending across the upper.

Clause 5. The article of footwear of Clauses 2-4, wherein the pump device includes a piston coupled to the actuator.

Clause 6. The article of footwear of Clause 5, wherein the pump device includes at least one biasing member coupled to the piston.

Clause 7. The article of footwear of Clause 6, wherein the at least one biasing member biases the piston in a first direction and the actuator is operable to move the piston in a second direction.

Clause 8. The article of footwear of Clause 5, further comprising a bearing coupled to the piston, the actuator being connected to the bearing.

Clause 9. The article of footwear of any of the preceding Clauses, further comprising a release in fluid communication with the pump device and operable to move the upper from the constricted state to the relaxed state.

Clause 10. The article of footwear of any of the preceding Clauses, wherein the pump device includes a valve in fluid communication with the chamber of the upper.

Clause 11. An article of footwear comprising an upper including a chamber, a pump attached to the article of footwear and in fluid communication with the chamber, the pump operable in a first state to evacuate fluid from the chamber and an actuator having a first portion connected to the pump and a second portion disposed along the upper, the actuator operable to move the pump into the first state to move the upper from a relaxed state to a constricted state by evacuating a fluid from the chamber.

Clause 12. The article of footwear of Clause 11, wherein the pump includes a housing and a piston disposed within the housing, the piston moveable in a first direction in the first state to draw fluid into the housing and in a second direction to exhaust fluid from the housing.

Clause 13. The article of footwear of Clause 12, wherein the pump includes a biasing member operable to bias the piston in the second direction.

Clause 14. The article of footwear of Clause 12 or 13, wherein the actuator is operable to move the piston in the first direction.

Clause 15. The article of footwear of Clauses 12-14, wherein a first portion of the actuator is connected to the piston.

Clause 16. The article of footwear of Clauses 12-15, wherein the housing includes a first bearing attached to the housing and the piston includes a second bearing attached to the piston, a first portion of the actuator being routed along the first bearing and a second portion of the actuator being routed along the second bearing.

Clause 17. The article of footwear of Clause 16, wherein the first bearing includes an arcuate first bearing surface and the second bearing includes an arcuate second bearing surface facing an opposite direction than the arcuate first bearing surface.

Clause 18. The article of footwear of any of Clauses 11-17, wherein the actuator includes a tightening grip extending around the upper.

Clause 19. The article of footwear of any of Clauses 11-18, further comprising a release operable to selectively permit a flow of fluid into the chamber to move the upper from the constricted state to the relaxed state.

Clause 20. The article of footwear of an of Clauses 11-19, wherein the chamber includes a compressible component disposed within the chamber.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An article of footwear comprising:

an upper including a chamber;

a sole structure including a recess forming a cavity;

a pump device disposed within the cavity, in fluid communication with the chamber, and operable to move the upper from a relaxed state to a constricted state by selectively evacuating fluid from the chamber; and an actuator cable routed through the pump device and including a tightening grip extending across a top of the upper, the actuator cable operable to actuate the pump device when an actuating force is applied to the tightening grip.

2. The article of footwear of claim 1, wherein the actuator cable is moveable in a tightening direction to move the upper from the relaxed state to the constricted state.

3. The article of footwear of claim 2, wherein the tightening grip is connected to the pump device.

4. The article of footwear of claim 1, wherein the pump device includes a piston coupled to the actuator cable.

5. The article of footwear of claim 4, wherein the pump device includes at least one biasing member coupled to the piston.

6. The article of footwear of claim 5, wherein the at least one biasing member biases the piston in a first direction and the actuator cable is operable to move the piston in a second direction.

7. The article of footwear of claim 4, further comprising a bearing coupled to the piston, the actuator cable being connected to the bearing.

8. The article of footwear of claim 1, further comprising a release in fluid communication with the pump device and operable to move the upper from the constricted state to the relaxed state.

9. The article of footwear of claim 1, wherein the pump device includes a valve in fluid communication with the chamber of the upper.

10. An article of footwear comprising:

an upper including a chamber;

a pump in fluid communication with the chamber, the pump operable in a first state to evacuate fluid from the chamber; and an actuator having a first portion routed through the pump and a second portion disposed along the upper, the actuator operable to move the pump into the first state to move the upper from a relaxed state to a constricted state by evacuating a fluid from the chamber when an actuating force is applied to the second portion by pulling the second portion away from the upper.

11. The article of footwear of claim 10, wherein the pump includes a housing and a piston disposed within the housing, the piston moveable in a first direction in the first state to draw fluid into the housing and in a second direction to exhaust fluid from the housing.

12. The article of footwear of claim 11, wherein the pump includes a biasing member operable to bias the piston in the second direction.

13. The article of footwear of claim 11, wherein the actuator is operable to move the piston in the first direction.

14. The article of footwear of claim 11, wherein the first portion of the actuator is connected to the piston.

15. The article of footwear of claim 11, wherein the housing includes a first bearing and the piston includes a second bearing, the first portion of the actuator being routed along the first bearing and a third portion of the actuator being routed along the second bearing.

16. The article of footwear of claim 15, wherein the first bearing includes an arcuate first bearing surface and the second bearing includes an arcuate second bearing surface facing an opposite direction than the arcuate first bearing surface.

17. The article of footwear of claim 10, wherein the second portion of the actuator includes a tightening grip extending around the upper.

18. The article of footwear of claim 10, further comprising a release operable to selectively permit a flow of fluid into the chamber to move the upper from the constricted state to the relaxed state.

19. The article of footwear of claim 10, wherein the chamber includes a compressible component disposed within the chamber.

* * * * *